US007329093B2

(12) United States Patent
Vandeputte et al.

(10) Patent No.: US 7,329,093 B2
(45) Date of Patent: Feb. 12, 2008

(54) NOZZLE BLADE AIRFOIL PROFILE FOR A TURBINE

(75) Inventors: Thomas W. Vandeputte, Simpsonville, SC (US); John E. Greene, Greenville, SC (US); Peter C. Selent, Taylors, SC (US); Linda J. Farral, Greenville, SC (US); Sze Bun Brian Chan, Greer, SC (US); Brian P. Arness, Simpsonville, SC (US)

(73) Assignee: General Electric Company, Schnectady, NY (US)

( * ) Notice: Subject to any disclaimer, the term of this patent is extended or adjusted under 35 U.S.C. 154(b) by 178 days.

(21) Appl. No.: 11/340,577

(22) Filed: Jan. 27, 2006

(65) Prior Publication Data

US 2007/0177981 A1 Aug. 2, 2007

(51) Int. Cl.
*F01D 9/00* (2006.01)

(52) U.S. Cl. ..... 415/191; 416/223 A; 416/DIG. 2

(58) Field of Classification Search ..... None
See application file for complete search history.

(56) References Cited

U.S. PATENT DOCUMENTS 5,980,209 A * 11/1999 Barry et al. ..... 416/223 A
6,398,489 B1 * 6/2002 Burdgick et al. ..... 415/115
6,450,770 B1 * 9/2002 Wang et al. ..... 416/223 A
6,461,109 B1 * 10/2002 Wedlake et al. ..... 416/223 R
6,461,110 B1 * 10/2002 By et al. ..... 416/223 A
6,474,948 B1 * 11/2002 Pirolla et al. ..... 416/243
6,503,054 B1 * 1/2003 Bielek et al. ..... 415/191
6,503,059 B1 * 1/2003 Frost et al. ..... 416/223 A
6,558,122 B1 * 5/2003 Xu et al. ..... 416/223 A
6,685,434 B1 * 2/2004 Humanchuk et al. ... 416/223 A
6,715,990 B1 * 4/2004 Arness et al. ..... 416/223 A
6,722,852 B1 * 4/2004 Wedlake et al. ..... 416/223 A
6,722,853 B1 * 4/2004 Humanchuk et al. ... 416/223 A
6,736,599 B1 * 5/2004 Jacks et al. ..... 415/191
6,739,838 B1 * 5/2004 Bielek et al. ..... 416/223 A
6,739,839 B1 * 5/2004 Brown et al. ..... 416/223 A
6,769,878 B1 * 8/2004 Parker et al. ..... 416/243
6,769,879 B1 * 8/2004 Cleveland et al. ..... 416/243
6,779,977 B2 * 8/2004 Lagrange et al. ..... 416/223 A
6,779,980 B1 * 8/2004 Brittingham et al. ..... 416/243
6,808,368 B1 * 10/2004 Tomberg et al. ..... 416/223 A (Continued)

OTHER PUBLICATIONS

U.S. Appl. No. 11/226,264, filed Sep. 15, 2004, entitled: Rotor Blade for a First Phase of a Gas Turbine.

(Continued)

*Primary Examiner*—Richard Edgar
(74) *Attorney, Agent, or Firm*—Nixon & Vanderhye, PC

(57) ABSTRACT

First stage stator vanes for a turbine comprised airfoil profile substantially in accordance with Cartesian coordinate values of X, Y and Z set forth in inches in Table I, which define a plurality of radially spaced profile sections forming the nominal profile. The Z coordinate values for each profile section are radial distances from the turbine axis to a portion of the surface of revolution about the axis containing the profile section. The X and Y values for each profile section are coordinate values which, when connected by smooth continuing arcs define the airfoil profile section along the surface of revolution portion. The radially spaced profile sections are joined smoothly with one another to form the nominal airfoil profile.

9 Claims, 3 Drawing Sheets

U.S. PATENT DOCUMENTS 6,832,897 B2 * 12/2004 Urban ..... 416/223 A
6,854,961 B2 * 2/2005 Zhang et al. ..... 416/223 A
6,857,855 B1 * 2/2005 Snook et al. ..... 416/223 A
6,866,477 B2 * 3/2005 Arness et al. ..... 415/191
6,881,038 B1 * 4/2005 Beddard et al. ..... 416/243
6,884,038 B2 * 4/2005 Hyde et al. ..... 416/223 A
6,887,041 B2 * 5/2005 Coke et al. ..... 415/191
6,910,868 B2 * 6/2005 Hyde et al. ..... 416/223 R
6,932,577 B2 * 8/2005 Strohl et al. ..... 416/223 A
7,001,147 B1 * 2/2006 Phillips et al. ..... 415/191
7,094,034 B2 * 8/2006 Fukuda et al. ..... 416/223 A
7,186,090 B2 * 3/2007 Tomberg et al. ..... 416/223 A
2003/0017052 A1 * 1/2003 Frost et al. ..... 416/223 A
2003/0021680 A1 * 1/2003 Bielek et al. ..... 415/191
2004/0057833 A1 * 3/2004 Arness et al. ..... 416/243
2004/0115058 A1 * 6/2004 Lagrange et al. ..... 416/223 A
2004/0175271 A1 * 9/2004 Coke et al. ..... 416/223 A
2004/0223849 A1 * 11/2004 Urban ..... 416/223 A
2004/0241002 A1 * 12/2004 Zhang et al. ..... 416/223 A
2005/0013692 A1 * 1/2005 Snook et al. ..... 416/191
2005/0013695 A1 * 1/2005 Hyde et al. ..... 416/243
2005/0019160 A1 * 1/2005 Hyde et al. ..... 415/213.1
2005/0025618 A1 * 2/2005 Arness et al. ..... 415/191
2005/0031453 A1 * 2/2005 Snook et al. ..... 416/223 A
2005/0079061 A1 * 4/2005 Beddard et al. ..... 416/243
2006/0024159 A1 * 2/2006 Phillips et al. ..... 415/191
2006/0073014 A1 * 4/2006 Tomberg et al. ..... 416/96 R
2006/0216144 A1 * 9/2006 Sullivan et al. ..... 415/191
2007/0048143 A1 * 3/2007 Noshi ..... 416/223 R
2007/0154316 A1 * 7/2007 Clarke ..... 416/223 R
2007/0154318 A1 * 7/2007 Saltman et al. ..... 416/241 R
2007/0177980 A1 * 8/2007 Keener et al. ..... 416/223 R
2007/0177981 A1 * 8/2007 Vandeputte et al. .... 416/223 R
2007/0183895 A1 * 8/2007 Sheffield ..... 416/223 R
2007/0183896 A1 * 8/2007 Jay et al. ..... 416/223 R
2007/0183897 A1 * 8/2007 Sadler et al. ..... 416/223 R
2007/0183898 A1 * 8/2007 Hurst et al. ..... 416/223 R
2007/0201983 A1 * 8/2007 Arinci et al. ..... 416/223 R
2007/0207035 A1 * 9/2007 Girgis et al. ..... 416/223 A
2007/0207036 A1 * 9/2007 Girgis et al. ..... 416/223 A
2007/0207037 A1 * 9/2007 Girgis et al. ..... 416/223 A
2007/0207038 A1 * 9/2007 Girgis et al. ..... 416/223 A

OTHER PUBLICATIONS

U.S. Appl. No. 10/853,240, filed May 26, 2004, entitled: Internal Core Profile for a Turbine Nozzle Airfoil.
U.S. Appl. No. 10/986,162, filed Nov. 12, 2004, entitled: Airfoil Shape for a Compressor Blade.
U.S. Appl. No. 11/090,300, filed Mar. 28, 2005, entitled: First and Second Stage Turbine Airfoil Shapes.
U.S. Appl. No. 11/340,532, filed Jan. 27, 2006, entitled: Stator Blade Airfoil Profile for a Compressor.

* cited by examiner

NOZZLE BLADE AIRFOIL PROFILE FOR A TURBINE

BACKGROUND OF THE INVENTION

The present invention relates to a turbine and particularly relates to a nozzle blade airfoil profile for a gas turbine, particularly, the first stage nozzle blade profile.

The hot gas path of a turbine requires nozzle blade profiles that meet system requirements of efficiency and loading. The airfoil shape of the nozzle blades must optimize the interaction between other stages in the turbine, provide for aerodynamic efficiency and optimize aerodynamic life objectives. Particularly, nozzle blade airfoil profile affects nozzle stage positional stability and part life. Accordingly, there is a need for a nozzle airfoil profile which optimizes these objectives.

BRIEF SUMMARY OF THE INVENTION

In a preferred embodiment of the present invention, there is provided a nozzle blade for a turbine having an airfoil, the airfoil having an uncoated nominal profile substantially in accordance with Cartesian coordinate values of X, Y and Z set forth in inches in Table I which define a plurality of radially spaced profile sections forming the nominal profile, the Z coordinate values for each profile section being radial distances from the turbine axis to a portion of a surface of revolution about the turbine axis containing the profile section, and the X and Y values for each profile section being coordinate values which, when connected by smooth continuing arcs define the airfoil profile section along the surface of revolution portion, the radially spaced profile sections being joined smoothly with one another to form the nominal airfoil profile.

In a further preferred embodiment of the present invention, there is provided a nozzle blade for a turbine having an airfoil, the airfoil having a shape in an envelope within ±0.160 inches in a direction normal to any airfoil surface location, the airfoil having an uncoated nominal profile substantially in accordance with Cartesian coordinate values of X, Y and Z set forth in inches in Table I which define a plurality of radially spaced profile sections forming the nominal profile, the Z coordinate values for each profile section being radial distances from the turbine axis to a portion of a surface of revolution about the turbine axis containing the profile section, and the X and Y values for each profile section being coordinate values which, when connected by smooth continuing arcs define the airfoil profile section along the surface of revolution portion, the radially spaced profile sections being joined smoothly with one another to form the nominal airfoil profile.

In an even further preferred embodiment of the present invention, there is provided a turbine having a plurality of nozzle blades forming a portion of a turbine stage, each nozzle blade being in the shape of an airfoil, each airfoil having an uncoated nominal profile substantially in accordance with Cartesian coordinate values of X, Y and Z set forth in inches in Table I which define a plurality of radially spaced profile sections forming the nominal profile, the Z coordinate values for each profile section being radial distances from the turbine axis to a portion of a surface of revolution about the turbine axis containing the profile section, and the X and Y values for each profile section being coordinate values which, when connected by smooth continuing arcs define the airfoil profile section along the surface of revolution portion, the radially spaced profile sections being joined smoothly with one another to form the nominal airfoil profile.

In still another aspect of the present invention, a turbine having a plurality of nozzle blades forming a portion of a turbine stage, each nozzle blade being in the shape of an airfoil, each the airfoil having an uncoated nominal profile substantially in accordance with Cartesian coordinate values of X, Y and Z set forth in inches in Table I which define a plurality of radially spaced profile sections forming the nominal profile, the Z coordinate values for each profile section being radial distances from the turbine axis to a portion of a surface of revolution about the turbine axis containing the profile section, and the X and Y values for each profile section being coordinate values which, when connected by smooth continuing arcs define the airfoil profile section along the surface of revolution portion, the radially spaced profile sections being joined smoothly with one another to form the nominal airfoil profile, each airfoil having a shape within ±0.0160 inches in a direction normal to any airfoil surface location.

DETAILED DESCRIPTION OF THE DRAWINGS

Figure 1:
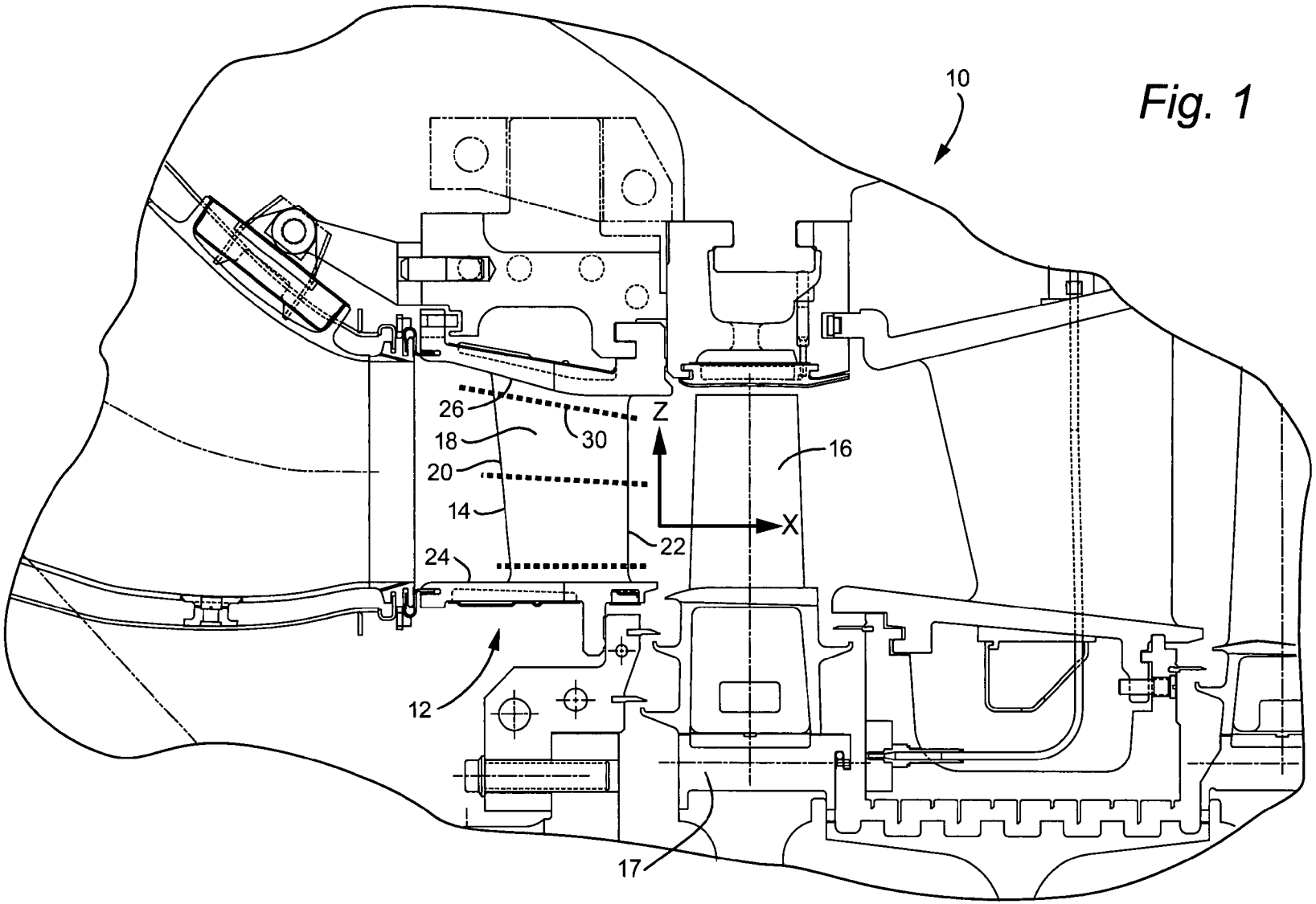
FIG. 1 is a fragmentary schematic cross-sectional view of a turbine illustrating a first stage thereof including a nozzle blade having an airfoil profile according to a preferred embodiment of the present invention.

Referring now to FIG. 1, there is illustrated a portion of a turbine, generally designated 10, having multiple stages, including a first stage, generally designated 12. The first stage includes a plurality of circumferentially spaced nozzles 14, as well as buckets 16 mounted on the rotor 17. The first stage nozzles 14 have a plurality of circumferentially spaced airfoils or blades 18 of a particular airfoil shape or profile as specified below.

Figure 2:
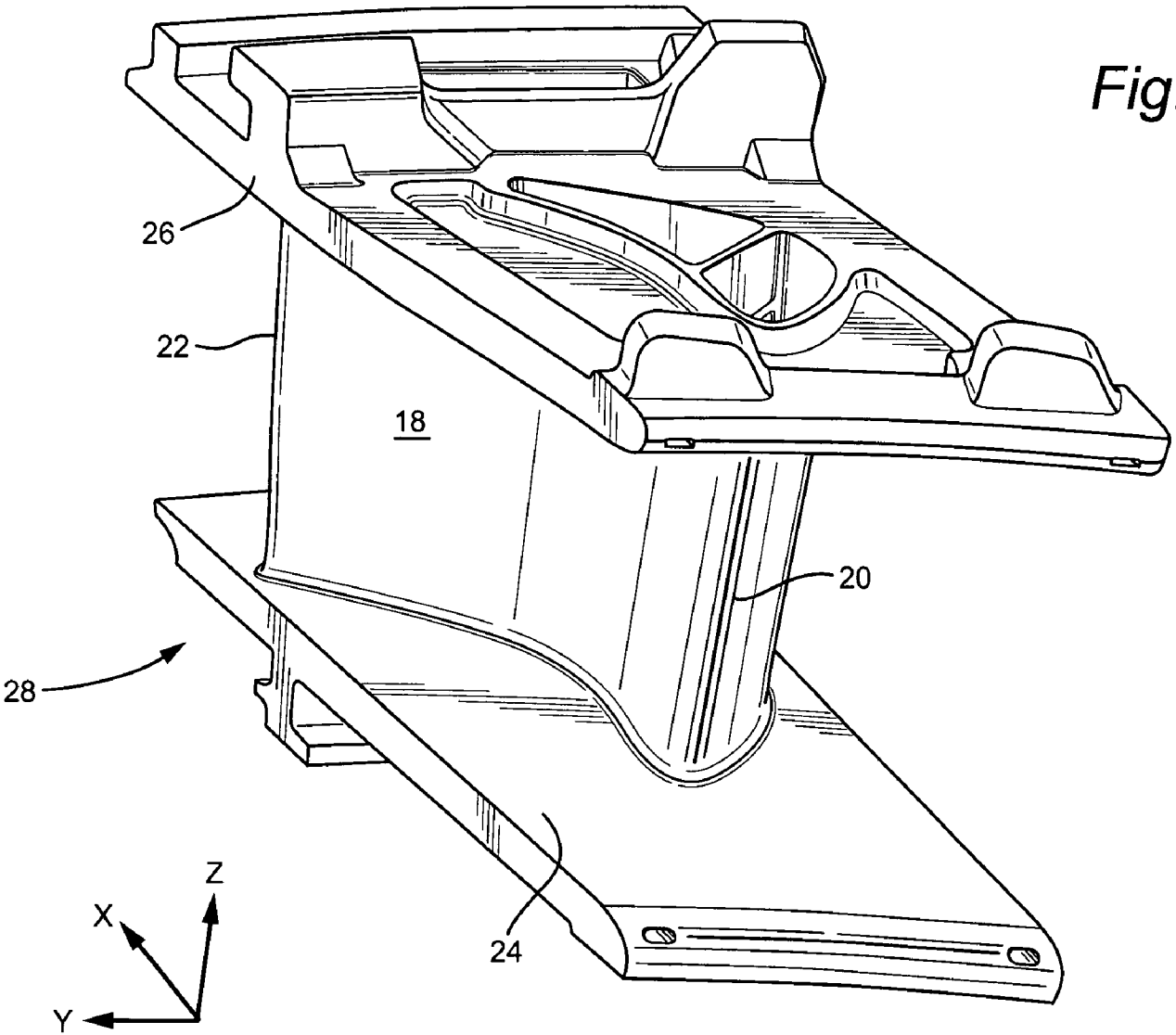
FIG. 2 is a perspective view of a nozzle segment for the first stage of the turbine illustrating the airfoil hereof.

Referring to FIGS. 1 and 2, the airfoil shape or profile of each nozzle airfoil includes leading and trailing edges 20 and 22, respectively. The nozzle airfoils are disposed between inner and outer side walls 24 and 26, respectively. The side walls and the airfoil between the sidewalls constitute a nozzle segment generally designated 28 in FIG. 2. In the preferred and illustrated embodiment of the first stage nozzle, there are forty-eight circumferentially spaced blades and hence forty-eight segments 28.

Each of the first stage nozzle blades has an airfoil profile defined by a Cartesian coordinate system of X, Y and Z values. The coordinate values are set forth in inches in Table I below. The Cartesian coordinate system includes orthogonally related X, Y and Z axes. The X axis lies along the turbine rotor center line, i.e., the rotor axis. The Z axis extends along radii from the center line of the turbine rotor to the X and Y coordinate values for the respective sets of X, Y and Z coordinate values. That is, each Z distance commences at zero along the turbine axis and extends to a point defined by the X and Y coordinate values for those X, Y and Z coordinate values.

Figure 3:
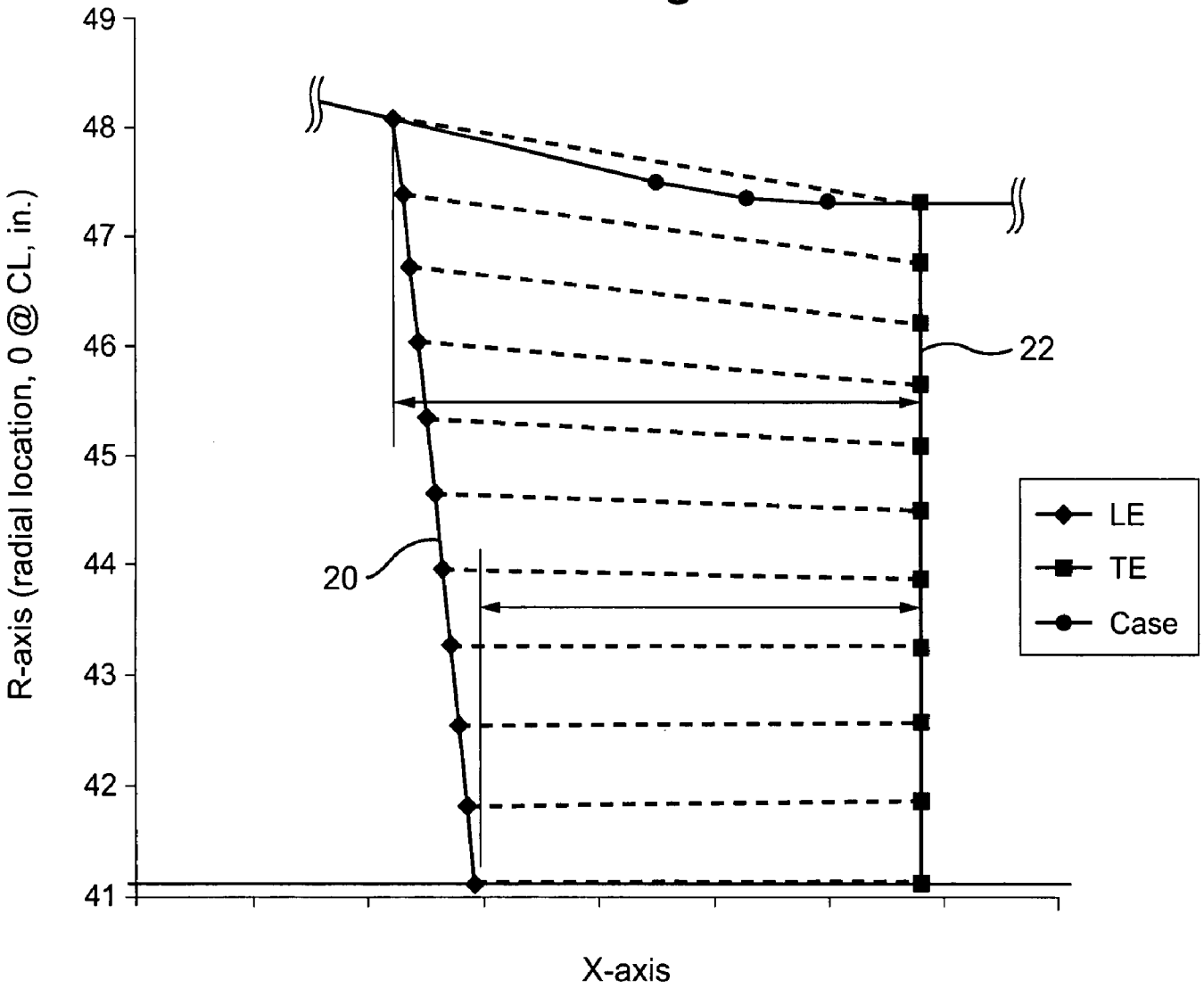
FIG. 3 is a schematic illustration of the nozzle airfoil illustrating the location of the profile sections for the X, Y and Z coordinates of Table I which follows.

The airfoil profile sections between the inner and outer side walls are given in eleven sets of X, Y and Z coordinate values, and hence eleven profile sections, represented by the dashed lines in FIG. 3. Each profile section lies in and conforms to a portion of a surface of revolution about the turbine axis. For example, as illustrated in FIG. 1 by the dashed outermost-line 30, the profile section at that location for a single airfoil lies in a portion of a conical surface of revolution about the turbine axis. The profile section per se extends in both an arcuate circumferential direction and a longitudinal direction along the surface portion of the conical surface of revolution about the turbine axis. The profile sections defined by the X, Y and Z coordinate values of Table I are therefore not planar but have an arcuate extent in the circumferential direction. Because the profile sections are not taken in planes perpendicular to the turbine axis, the Z coordinate values are different from one another within each set of X, Y and Z coordinate values for each profile section.

By defining X and Y coordinate values at selected locations in the Z direction along radii from the turbine axis, the profile of each airfoil section of the eleven sections can be ascertained. By connecting the X, Y and Z values in each profile section with smooth continuing arcs, the profile of the blade at each section is ascertained. The surface profiles at the various surface locations between the profile sections are connected smoothly to one another to form a nominal airfoil profile.

The tabular values given in Table I are in inches and represent the airfoil profiles at ambient, non-operating or non-hot conditions and are for an uncoated airfoil. The X, Y and Z coordinate values given in Table I are in scientific notation represented by the letter E followed by numerical values. The numerical values represent the number of spaces to move the decimal point of the number preceding the scientific notation E to give the actual value in inches. The plus or minus signs indicate the direction of movement of the decimal points, i.e., the plus sign signals movement of the decimal point to the right and the minus sign signals movement of the decimal point to the left. The 78 points defined by the X, Y and Z coordinate values of Table I for each profile section are for a nominal cold or room temperature profile for each profile section of the airfoil.

There are typical manufacturing tolerances as well as coatings which must be accounted for in the actual profile of the airfoil. Accordingly, the values for the profile given in Table I are for a nominal airfoil. It will therefore be appreciated that typical manufacturing tolerances, i.e., ±values and coating thicknesses are added to or subtracted from the X, Y and Z values given in Table I below. Accordingly, a distance of ±0.160 inches in a direction normal to any surface location along the airfoil profile, defines an airfoil envelope for this particular airfoil design. In a preferred embodiment, the blade airfoil profiles given in Table I below are for the first stage blades of the turbine.

The coordinate values given in Table I below are in inches and provides the preferred nominal profile envelope.

TABLE I

| X | Y | Z |
|---|---|---|
| −7.91400E−01, | 2.19440E+00, | 4.62400E+01 |
| −1.46860E+00, | −7.08000E−02, | 4.63382E+01 |
| −2.49950E+00, | −1.61540E+00, | 4.64562E+01 |
| −3.00010E+00, | −1.75920E+00, | 4.71098E+01 |
| −3.58100E+00, | −1.66730E+00, | 4.66623E+01 |
| −1.17520E+00, | 8.28900E−01, | 4.63053E+01 |
| −2.18940E+00, | −1.31720E+00, | 4.69255E+01 |
| −1.90340E+00, | −9.35900E−01, | 4.68823E+01 |

TABLE I-continued

| X | Y | Z |
|---|---|---|
| −1.64400E+00, | −5.10500E−01, | 4.63543E+01 |
| −1.68200E+00, | −5.11500E−01, | 4.68609E+01 |
| −3.75040E+00, | −1.58720E+00, | 4.66998E+01 |
| −2.94070E+00, | −1.76720E+00, | 4.65327E+01 |
| −1.34690E+00, | 3.85000E−01, | 4.68318E+01 |
| −3.81010E+00, | −1.57810E+00, | 4.73251E+01 |
| −9.36900E−01, | 1.76060E+00, | 4.67806E+01 |
| −1.31550E+00, | 3.77100E−01, | 4.63226E+01 |
| −2.13820E+00, | −1.31390E+00, | 4.64057E+01 |
| −1.04270E+00, | 1.28290E+00, | 4.62860E+01 |
| −3.40410E+00, | −1.72810E+00, | 4.66244E+01 |
| −1.06760E+00, | 1.30040E+00, | 4.68006E+01 |
| −3.64020E+00, | −1.65790E+00, | 4.72780E+01 |
| −1.20340E+00, | 8.41500E−01, | 4.68172E+01 |
| −1.85960E+00, | −9.32000E−01, | 4.63743E+01 |
| −1.50310E+00, | −6.75000E−02, | 4.68456E+01 |
| −2.55740E+00, | −1.61370E+00, | 4.70003E+01 |
| −8.09800E−01, | 2.22150E+00, | 4.67578E+01 |
| −9.15200E−01, | 1.73830E+00, | 4.62645E+01 |
| −3.46300E+00, | −1.71840E+00, | 4.72298E+01 |
| −4.12760E+00, | −1.37460E+00, | 4.74133E+01 |
| −3.24230E+00, | 3.58900E−01, | 4.72028E+01 |
| −4.27560E+00, | −1.25610E+00, | 4.74547E+01 |
| −4.41700E+00, | −1.12900E+00, | 4.74944E+01 |
| −2.93770E+00, | 5.19600E−01, | 4.71239E+01 |
| −3.97260E+00, | −1.48270E+00, | 4.73701E+01 |
| −4.65190E+00, | −3.36500E−01, | 4.75671E+01 |
| −4.56290E+00, | −2.28000E−01, | 4.75448E+01 |
| −4.55230E+00, | −9.94700E−01, | 4.75322E+01 |
| −4.68450E+00, | −3.99400E−01, | 4.75750E+01 |
| −4.08030E+00, | 4.35000E−02, | 4.74210E+01 |
| −3.56180E+00, | 2.31200E−01, | 4.72860E+01 |
| −4.70810E+00, | −4.66300E−01, | 4.75804E+01 |
| −3.82180E+00, | 1.40400E−01, | 4.73543E+01 |
| −4.33070E+00, | −7.49000E−02, | 4.74855E+01 |
| −3.69170E+00, | 1.85600E−01, | 4.73200E+01 |
| −4.66900E+00, | −8.43600E−01, | 4.75652E+01 |
| −4.72700E+00, | −6.10600E−01, | 4.75837E+01 |
| −4.70530E+00, | −7.54200E−01, | 4.75760E+01 |
| −4.70810E+00, | −4.66300E−01, | 4.75804E+01 |
| −3.95160E+00, | 9.37000E−02, | 4.73879E+01 |
| −4.20700E+00, | −1.21000E−02, | 4.74537E+01 |
| −4.72430E+00, | −6.59000E−01, | 4.75823E+01 |
| −4.69760E+00, | −4.32900E−01, | 4.75780E+01 |
| −4.45030E+00, | −1.45800E−01, | 4.75161E+01 |
| −4.61110E+00, | −2.79000E−01, | 4.75570E+01 |
| −4.66930E+00, | −3.67300E−01, | 4.75713E+01 |
| −4.71870E+00, | −5.12600E−01, | 4.75827E+01 |
| −4.72520E+00, | −5.61800E−01, | 4.75838E+01 |
| −1.95140E+00, | 1.48070E+00, | 4.68752E+01 |
| −1.90400E+00, | 1.45400E+00, | 4.63668E+01 |
| −1.04790E+00, | 2.95140E+00, | 4.62099E+01 |
| −4.91700E−01, | 3.33630E+00, | 4.61655E+01 |
| −1.22700E+00, | 2.67560E+00, | 4.67495E+01 |
| −2.11350E+00, | 1.17970E+00, | 4.64054E+01 |
| −5.62100E−01, | 3.14460E+00, | 4.67036E+01 |
| −4.32900E−01, | 3.56480E+00, | 4.61481E+01 |
| −1.56730E+00, | 2.06430E+00, | 4.68061E+01 |
| −1.20160E+00, | 2.64220E+00, | 4.62393E+01 |
| −1.39280E+00, | 2.36750E+00, | 4.67768E+01 |
| −4.35360E+00, | −1.14010E+00, | 4.68374E+01 |
| −2.59710E+00, | 6.89500E−01, | 4.64965E+01 |
| −2.16550E+00, | 1.20630E+00, | 4.69234E+01 |
| −6.23400E−01, | 2.91380E+00, | 4.67183E+01 |
| −2.39930E+00, | 9.49800E−01, | 4.69808E+01 |
| −6.85100E−01, | 2.68300E+00, | 4.67322E+01 |
| −2.65620E+00, | 7.18200E−01, | 4.70470E+01 |
| −2.34330E+00, | 9.22500E−01, | 4.64484E+01 |
| −2.87670E+00, | 4.89100E−01, | 4.65516E+01 |
| −5.01200E−01, | 3.37560E+00, | 4.66882E+01 |
| −4.21310E+00, | −1.26610E+00, | 4.68047E+01 |
| −3.17970E+00, | 3.27400E−01, | 4.66111E+01 |
| −5.50900E−01, | 3.10780E+00, | 4.61819E+01 |
| −3.91190E+00, | −1.49170E+00, | 4.67359E+01 |
| −1.06810E+00, | 2.98760E+00, | 4.67231E+01 |
| −1.53120E+00, | 2.03530E+00, | 4.63000E+01 |
| −6.10300E−01, | 2.87940E+00, | 4.61976E+01 |

TABLE I-continued

| X | Y | Z |
|---|---|---|
| −1.36210E+00, | 2.33640E+00, | 4.62692E+01 |
| −8.99600E−01, | 3.26330E+00, | 4.61812E+01 |
| −4.40500E−01, | 3.60660E+00, | 4.66720E+01 |
| −1.71090E+00, | 1.74040E+00, | 4.63322E+01 |
| −3.74400E−01, | 3.79340E+00, | 4.61299E+01 |
| −6.70200E−01, | 2.65100E+00, | 4.62126E+01 |
| −1.75260E+00, | 1.76800E+00, | 4.68386E+01 |
| −4.06600E+00, | −1.38400E+00, | 4.67710E+01 |
| −3.80200E−01, | 3.83750E+00, | 4.66550E+01 |
| −3.20000E−01, | 4.06850E+00, | 4.66372E+01 |
| −3.02400E−01, | 4.56410E+00, | 4.60606E+01 |
| −4.10500E−01, | 4.41760E+00, | 4.66029E+01 |
| −4.58550E+00, | −3.57400E−01, | 4.68989E+01 |
| −4.61780E+00, | −4.19400E−01, | 4.69052E+01 |
| −4.26640E+00, | −9.92000E−02, | 4.68329E+01 |
| −4.48810E+00, | −1.00720E+00, | 4.68688E+01 |
| −4.64130E+00, | −4.85300E−01, | 4.69096E+01 |
| −4.49730E+00, | −2.50200E−01, | 4.68809E+01 |
| −6.22700E−01, | 3.93770E+00, | 4.66432E+01 |
| −5.51500E−01, | 4.09740E+00, | 4.66298E+01 |
| −4.80800E−01, | 4.25740E+00, | 4.66163E+01 |
| −6.94600E−01, | 3.77830E+00, | 4.66564E+01 |
| −2.48400E−01, | 4.56670E+00, | 4.60610E+01 |
| −3.40600E−01, | 4.57790E+00, | 4.65893E+01 |
| −4.08600E−01, | 4.36720E+00, | 4.60790E+01 |
| −3.25100E−01, | 4.54850E+00, | 4.60619E+01 |
| −7.67200E−01, | 3.61920E+00, | 4.66698E+01 |
| −4.63090E+00, | −4.52500E−01, | 4.69077E+01 |
| −2.06900E−01, | 4.53220E+00, | 4.60652E+01 |
| −4.63920E+00, | −7.69200E−01, | 4.69054E+01 |
| −2.24400E−01, | 4.55340E+00, | 4.60628E+01 |
| −4.66030E+00, | −6.27500E−01, | 4.69119E+01 |
| −8.40700E−01, | 3.46050E+00, | 4.66830E+01 |
| −4.65180E+00, | −5.30900E−01, | 4.69114E+01 |
| −4.01660E+00, | 1.67000E−02, | 4.67812E+01 |
| −6.15100E−01, | 3.89250E+00, | 4.61234E+01 |
| −5.45800E−01, | 4.05050E+00, | 4.61087E+01 |
| −2.48400E−01, | 4.56670E+00, | 4.60610E+01 |
| −2.58000E−01, | 4.25030E+00, | 4.60912E+01 |
| −4.60270E+00, | −3.87800E−01, | 4.69023E+01 |
| −3.02300E−01, | 4.61630E+00, | 4.65868E+01 |
| −1.98400E−01, | 4.50620E+00, | 4.60679E+01 |
| −2.48100E−01, | 4.61880E+00, | 4.65886E+01 |
| −4.38550E+00, | −1.69000E−01, | 4.68577E+01 |
| −3.49860E+00, | 2.00300E−01, | 4.66749E+01 |
| −2.48100E−01, | 4.61880E+00, | 4.65886E+01 |
| −4.54510E+00, | −3.00600E−01, | 4.68907E+01 |
| −2.00100E−01, | 4.47880E+00, | 4.60705E+01 |
| −4.14300E+00, | −3.77000E−02, | 4.68073E+01 |
| −9.15300E−01, | 3.30230E+00, | 4.66964E+01 |
| −6.85100E−01, | 3.73470E+00, | 4.61379E+01 |
| −2.60000E−01, | 4.29950E+00, | 4.66187E+01 |
| −4.77000E−01, | 4.20870E+00, | 4.60940E+01 |
| −2.00100E−01, | 4.53050E+00, | 4.65994E+01 |
| −2.75600E−01, | 4.57050E+00, | 4.60603E+01 |
| −8.27100E−01, | 3.42000E+00, | 4.61668E+01 |
| −3.40400E−01, | 4.52570E+00, | 4.60641E+01 |
| −7.55700E−01, | 3.57720E+00, | 4.61525E+01 |
| −2.75400E−01, | 4.62270E+00, | 4.65871E+01 |
| −3.62830E+00, | 1.55300E−01, | 4.67015E+01 |
| −3.25100E−01, | 4.60070E+00, | 4.65876E+01 |
| −3.16100E−01, | 4.02180E+00, | 4.61110E+01 |
| −4.65770E+00, | −6.75200E−01, | 4.69108E+01 |
| −2.06700E−01, | 4.58400E+00, | 4.65938E+01 |
| −4.65840E+00, | −5.79400E−01, | 4.69121E+01 |
| −1.98300E−01, | 4.55790E+00, | 4.65968E+01 |
| −4.64130E+00, | −4.85300E−01, | 4.69096E+01 |
| −2.24100E−01, | 4.60540E+00, | 4.65910E+01 |
| −4.60350E+00, | −8.57500E−01, | 4.68962E+01 |
| −3.88800E+00, | 6.57000E−02, | 4.67547E+01 |
| −3.75830E+00, | 1.11200E−01, | 4.67283E+01 |
| −7.73900E−01, | 2.16110E+00, | 4.57051E+01 |
| −1.22960E+00, | 3.13400E−01, | 4.46542E+01 |
| −3.85190E+00, | −1.50240E+00, | 4.60981E+01 |
| −1.74550E+00, | −9.65600E−01, | 4.46764E+01 |
| −1.57530E+00, | −5.34800E−01, | 4.52522E+01 |
| −3.46620E+00, | −1.68990E+00, | 4.54126E+01 |

TABLE I-continued

| X | Y | Z |
|---|---|---|
| −9.95600E−01, | 1.22860E+00, | 4.51979E+01 |
| −3.73390E+00, | −1.52470E+00, | 4.48058E+01 |
| −8.74100E−01, | 1.67650E+00, | 4.51779E+01 |
| −1.25760E+00, | 3.38000E−01, | 4.52298E+01 |
| −1.82080E+00, | −9.39500E−01, | 4.58311E+01 |
| −3.23720E+00, | −1.76320E+00, | 4.47594E+01 |
| −1.01900E+00, | 1.25730E+00, | 4.57510E+01 |
| −3.34700E+00, | −1.74000E+00, | 4.60128E+01 |
| −2.83180E+00, | −1.79200E+00, | 4.53420E+01 |
| −1.37510E+00, | −1.23400E−01, | 4.46631E+01 |
| −3.63340E+00, | −1.60910E+00, | 4.54340E+01 |
| −1.28640E+00, | 3.59300E−01, | 4.57866E+01 |
| −2.35160E+00, | −1.64810E+00, | 4.46998E+01 |
| −2.04930E+00, | −1.33080E+00, | 4.52793E+01 |
| −1.43700E+00, | −8.47000E−02, | 4.58011E+01 |
| −2.44770E+00, | −1.62460E+00, | 4.58898E+01 |
| −1.09700E+00, | 7.54100E−01, | 4.46422E+01 |
| −3.41070E+00, | −1.70100E+00, | 4.47745E+01 |
| −8.94600E−01, | 1.70880E+00, | 4.57296E+01 |
| −1.78260E+00, | −9.50700E−01, | 4.52635E+01 |
| −3.79250E+00, | −1.51350E+00, | 4.54555E+01 |
| −1.60950E+00, | −5.20700E−01, | 4.58150E+01 |
| −7.39600E−01, | 2.08680E+00, | 4.45881E+01 |
| −3.52310E+00, | −1.67860E+00, | 4.60414E+01 |
| −1.12250E+00, | 7.82200E−01, | 4.52151E+01 |
| −2.00770E+00, | −1.34380E+00, | 4.46853E+01 |
| −1.54190E+00, | −5.52500E−01, | 4.46699E+01 |
| −2.78130E+00, | −1.80440E+00, | 4.47254E+01 |
| −7.56500E−01, | 2.12520E+00, | 4.51544E+01 |
| −1.14870E+00, | 8.07200E−01, | 4.57699E+01 |
| −9.72800E−01, | 1.19710E+00, | 4.46274E+01 |
| −3.29130E+00, | −1.75190E+00, | 4.53914E+01 |
| −2.88520E+00, | −1.77940E+00, | 4.59448E+01 |
| −1.40570E+00, | −1.02300E−01, | 4.52417E+01 |
| −3.69140E+00, | −1.59810E+00, | 4.60699E+01 |
| −8.54100E−01, | 1.64150E+00, | 4.46096E+01 |
| −2.39810E+00, | −1.63560E+00, | 4.53033E+01 |
| −3.57630E+00, | −1.62010E+00, | 4.47900E+01 |
| −2.09300E+00, | −1.32070E+00, | 4.58542E+01 |
| −1.17980E+00, | 2.60480E+00, | 4.57053E+01 |
| −2.81980E+00, | 4.58100E−01, | 4.59677E+01 |
| −2.06920E+00, | 1.14970E+00, | 4.58559E+01 |
| −3.12030E+00, | 2.96200E−01, | 4.60116E+01 |
| −3.94420E+00, | −1.40610E+00, | 4.54768E+01 |
| −2.49340E+00, | 6.28100E−01, | 4.53381E+01 |
| −3.68800E−01, | 3.74650E+00, | 4.55923E+01 |
| −4.15070E+00, | −1.27750E+00, | 4.61525E+01 |
| −4.00480E+00, | −1.39480E+00, | 4.61257E+01 |
| −1.47230E+00, | 1.96640E+00, | 4.52043E+01 |
| −1.64330E+00, | 1.67470E+00, | 4.52302E+01 |
| −5.40000E−01, | 3.06680E+00, | 4.56459E+01 |
| −4.25600E−01, | 3.51990E+00, | 4.56110E+01 |
| −5.97700E−01, | 2.84030E+00, | 4.56619E+01 |
| −1.50090E+00, | 2.00190E+00, | 4.57634E+01 |
| −1.67610E+00, | 1.70850E+00, | 4.57930E+01 |
| −2.76570E+00, | 4.26900E−01, | 4.53687E+01 |
| −2.54380E+00, | 6.59100E−01, | 4.59268E+01 |
| −1.01320E+00, | 2.86990E+00, | 4.51243E+01 |
| −2.29440E+00, | 8.92600E−01, | 4.58898E+01 |
| −4.22740E+00, | −1.16520E+00, | 4.55180E+01 |
| −3.06330E+00, | 2.65400E−01, | 4.54004E+01 |
| −6.55900E−01, | 2.61380E+00, | 4.56772E+01 |
| −2.24820E+00, | 8.61500E−01, | 4.53098E+01 |
| −1.82730E+00, | 1.39080E+00, | 4.52563E+01 |
| −1.15920E+00, | 2.56530E+00, | 4.51515E+01 |
| −1.86440E+00, | 1.42330E+00, | 4.58237E+01 |
| −4.82600E−01, | 3.29330E+00, | 4.56289E+01 |
| −1.03010E+00, | 2.91170E+00, | 4.56762E+01 |
| −1.31160E+00, | 2.26380E+00, | 4.51782E+01 |
| −2.02750E+00, | 1.11810E+00, | 4.52829E+01 |
| −4.29030E+00, | −1.15240E+00, | 4.61784E+01 |
| −4.08890E+00, | −1.28940E+00, | 4.54976E+01 |
| −1.33610E+00, | 2.30120E+00, | 4.57344E+01 |
| −3.76470E+00, | 1.25000E−02, | 4.54775E+01 |
| −2.07200E−01, | 4.47940E+00, | 4.55255E+01 |
| −3.25300E−01, | 4.49510E+00, | 4.55242E+01 |
| −4.51790E+00, | −5.67600E−01, | 4.55660E+01 |

TABLE I-continued

| X | Y | Z |
|---|---|---|
| −3.63610E+00, | 5.56000E−02, | 4.54627E+01 |
| −3.82570E+00, | 3.88000E−02, | 4.61184E+01 |
| −4.41330E+00, | −3.43000E−01, | 4.55549E+01 |
| −6.08400E−01, | 3.84490E+00, | 4.55887E+01 |
| −4.46960E+00, | −4.28200E−01, | 4.55613E+01 |
| −4.01740E+00, | −8.62000E−02, | 4.55072E+01 |
| −4.25700E+00, | −2.13500E−01, | 4.55360E+01 |
| −4.50670E+00, | −8.00200E−01, | 4.55610E+01 |
| −1.98600E−01, | 4.45340E+00, | 4.55281E+01 |
| −3.56690E+00, | 1.26200E−01, | 4.60784E+01 |
| −4.59140E+00, | −5.97100E−01, | 4.62392E+01 |
| −4.52650E+00, | −6.61800E−01, | 4.55659E+01 |
| −3.43760E+00, | 1.70300E−01, | 4.60588E+01 |
| −4.57430E+00, | −5.04200E−01, | 4.62374E+01 |
| −4.53790E+00, | −8.72100E−01, | 4.62257E+01 |
| −4.49720E+00, | −4.91300E−01, | 4.55642E+01 |
| −4.59090E+00, | −6.91800E−01, | 4.62377E+01 |
| −2.00100E−01, | 4.42600E+00, | 4.55307E+01 |
| −4.51910E+00, | −3.78000E−01, | 4.62293E+01 |
| −2.76100E−01, | 4.51730E+00, | 4.55218E+01 |
| −6.76600E−01, | 3.68850E+00, | 4.56036E+01 |
| −4.55100E+00, | −4.39100E−01, | 4.62342E+01 |
| −4.20260E+00, | −1.22600E−01, | 4.61783E+01 |
| −3.12300E−01, | 3.97300E+00, | 4.55727E+01 |
| −2.56100E−01, | 4.19950E+00, | 4.55521E+01 |
| −4.57430E+00, | −5.04200E−01, | 4.62374E+01 |
| −4.43190E+00, | −2.71900E−01, | 4.62155E+01 |
| −7.45400E−01, | 3.53240E+00, | 4.56185E+01 |
| −3.95380E+00, | −8.90000E−03, | 4.61386E+01 |
| −4.36010E+00, | −1.03470E+00, | 4.55377E+01 |
| −2.48800E−01, | 4.51370E+00, | 4.55221E+01 |
| −3.69650E+00, | 8.31000E−02, | 4.60983E+01 |
| −4.47240E+00, | −8.87000E−01, | 4.55551E+01 |
| −8.15000E−01, | 3.37650E+00, | 4.56331E+01 |
| −8.85600E−01, | 3.22110E+00, | 4.56476E+01 |
| −4.73700E−01, | 4.15830E+00, | 4.55581E+01 |
| −4.50740E+00, | −5.23100E−01, | 4.55652E+01 |
| −4.50740E+00, | −5.23100E−01, | 4.55652E+01 |
| −4.52420E+00, | −7.08500E−01, | 4.55649E+01 |
| −3.02800E−01, | 4.51080E+00, | 4.55225E+01 |
| −4.45270E+00, | −3.98500E−01, | 4.55594E+01 |
| −4.52450E+00, | −6.14800E−01, | 4.55663E+01 |
| −4.48430E+00, | −4.58900E−01, | 4.55629E+01 |
| −4.13940E+00, | −1.45600E−01, | 4.55217E+01 |
| −4.47910E+00, | −3.21900E−01, | 4.62230E+01 |
| −3.40500E−01, | 4.47230E+00, | 4.55266E+01 |
| −4.36660E+00, | −2.93500E−01, | 4.55494E+01 |
| −2.24700E−01, | 4.50040E+00, | 4.55234E+01 |
| −4.53610E+00, | −4.08100E−01, | 4.62319E+01 |
| −4.58480E+00, | −5.49300E−01, | 4.62386E+01 |
| −3.89210E+00, | −3.41000E−02, | 4.54923E+01 |
| −4.32110E+00, | −1.91400E−01, | 4.61975E+01 |
| −4.57290E+00, | −7.84600E−01, | 4.62333E+01 |
| −4.59340E+00, | −6.44600E−01, | 4.62389E+01 |
| −5.40800E−01, | 4.00150E+00, | 4.55734E+01 |
| −3.50710E+00, | 9.77000E−02, | 4.54485E+01 |
| −4.42400E+00, | −1.02070E+00, | 4.62037E+01 |
| −4.07980E+00, | −6.21000E−02, | 4.61586E+01 |
| −4.56400E+00, | −4.71900E−01, | 4.62359E+01 |
| −2.48800E−01, | 4.51370E+00, | 4.55221E+01 |
| −4.07000E−01, | 4.31530E+00, | 4.55424E+01 |
| −3.37850E+00, | 1.40900E−01, | 4.54344E+01 |
| −3.63300E−01, | 3.69810E+00, | 4.50435E+01 |
| −4.18300E−01, | 3.47330E+00, | 4.50621E+01 |
| −5.29200E−01, | 3.02380E+00, | 4.50966E+01 |
| −5.85200E−01, | 2.79900E+00, | 4.51124E+01 |
| −5.73100E−01, | 2.75560E+00, | 4.45488E+01 |
| −8.59800E−01, | 3.13100E+00, | 4.45300E+01 |
| −2.71520E+00, | 3.95900E−01, | 4.47552E+01 |
| −5.18700E−01, | 2.97870E+00, | 4.45338E+01 |
| −9.97400E−01, | 2.82630E+00, | 4.45549E+01 |
| −1.61340E+00, | 1.63920E+00, | 4.46478E+01 |
| −3.88410E+00, | −1.41780E+00, | 4.48218E+01 |
| −6.28000E−01, | 2.53260E+00, | 4.45629E+01 |
| −1.44610E+00, | 1.92900E+00, | 4.46257E+01 |
| −4.16460E+00, | −1.17850E+00, | 4.48530E+01 |
| −3.32190E+00, | 1.12100E−01, | 4.48002E+01 |

TABLE I-continued

| X | Y | Z |
|---|---|---|
| −3.00950E+00, | 2.35000E−01, | 4.47771E+01 |
| −2.20600E+00, | 8.29700E−01, | 4.47119E+01 |
| −1.79340E+00, | 1.35690E+00, | 4.46696E+01 |
| −1.14000E+00, | 2.52380E+00, | 4.45793E+01 |
| −6.41800E−01, | 2.57430E+00, | 4.51274E+01 |
| −4.64800E−01, | 3.20190E+00, | 4.45177E+01 |
| −3.58000E−01, | 3.64820E+00, | 4.44829E+01 |
| −1.98950E+00, | 1.08550E+00, | 4.46911E+01 |
| −4.02740E+00, | −1.30180E+00, | 4.48375E+01 |
| −2.44690E+00, | 5.96800E−01, | 4.47331E+01 |
| −4.73600E−01, | 3.24850E+00, | 4.50799E+01 |
| −1.28900E+00, | 2.22440E+00, | 4.46030E+01 |
| −4.11200E−01, | 3.42500E+00, | 4.45008E+01 |
| −4.44020E+00, | −5.42100E−01, | 4.48903E+01 |
| −4.67700E−01, | 4.05330E+00, | 4.44483E+01 |
| −4.44020E+00, | −5.42100E−01, | 4.48903E+01 |
| −4.45730E+00, | −7.25500E−02, | 4.48893E+01 |
| −3.08700E−01, | 3.92280E+00, | 4.50239E+01 |
| −4.45720E+00, | −6.32800E−01, | 4.48907E+01 |
| −4.41730E+00, | −4.78700E−01, | 4.48889E+01 |
| −4.07660E+00, | −1.68400E−01, | 4.48604E+01 |
| −2.49300E−01, | 4.45970E+00, | 4.49735E+01 |
| −2.76600E−01, | 4.46320E+00, | 4.49733E+01 |
| −1.98800E−01, | 4.34500E+00, | 4.44205E+01 |
| −4.30140E+00, | −3.15000E−01, | 4.48797E+01 |
| −4.29620E+00, | −1.04920E+00, | 4.48680E+01 |
| −3.83140E+00, | −5.89000E−02, | 4.48398E+01 |
| −4.70600E−01, | 4.10650E+00, | 4.50098E+01 |
| −2.25600E−01, | 4.39180E+00, | 4.44157E+01 |
| −4.45070E+00, | −5.86200E−01, | 4.48907E+01 |
| −2.49800E−01, | 4.40470E+00, | 4.44144E+01 |
| −6.60700E−01, | 3.59100E+00, | 4.44906E+01 |
| −5.31500E−01, | 3.89910E+00, | 4.44628E+01 |
| −3.03800E−01, | 4.40120E+00, | 4.44146E+01 |
| −3.95570E+00, | −1.10000E−01, | 4.48502E+01 |
| −1.98700E−01, | 4.39970E+00, | 4.49793E+01 |
| −7.26200E−01, | 3.43730E+00, | 4.45041E+01 |
| −3.40700E−01, | 4.41780E+00, | 4.49784E+01 |
| −2.25200E−01, | 4.44660E+00, | 4.49747E+01 |
| −3.03200E−01, | 4.45660E+00, | 4.49742E+01 |
| −3.05100E−01, | 3.87130E+00, | 4.44640E+01 |
| −4.40290E+00, | −4.48400E−01, | 4.48878E+01 |
| −4.04200E−01, | 4.20770E+00, | 4.44336E+01 |
| −4.19310E+00, | −2.35600E−01, | 4.48704E+01 |
| −5.36000E−01, | 3.95110E+00, | 4.50250E+01 |
| −3.44940E+00, | 6.98000E−02, | 4.48097E+01 |
| −4.44020E+00, | −8.16200E−01, | 4.48861E+01 |
| −4.34740E+00, | −3.64100E−01, | 4.48834E+01 |
| −4.45940E+00, | −6.79200E−01, | 4.48902E+01 |
| −8.72300E−01, | 3.17700E+00, | 4.50972E+01 |
| −2.00000E−01, | 4.31760E+00, | 4.44232E+01 |
| −2.49300E−01, | 4.45970E+00, | 4.49735E+01 |
| −2.52400E−01, | 4.09450E+00, | 4.44441E+01 |
| −6.68400E−01, | 3.64060E+00, | 4.50547E+01 |
| −3.57740E+00, | 2.88000E−02, | 4.48193E+01 |
| −4.43010E+00, | −5.10700E−01, | 4.48897E+01 |
| −3.26100E−01, | 4.38520E+00, | 4.44161E+01 |
| −8.03500E−01, | 3.33120E+00, | 4.50832E+01 |
| −2.77100E−01, | 4.40810E+00, | 4.44140E+01 |
| −7.92600E−01, | 3.28400E+00, | 4.45172E+01 |
| −2.07800E−01, | 4.37090E+00, | 4.44179E+01 |
| −2.00000E−01, | 4.37230E+00, | 4.49820E+01 |
| −4.05500E−01, | 4.26220E+00, | 4.49942E+01 |
| −2.07500E−01, | 4.42560E+00, | 4.49768E+01 |
| −5.95900E−01, | 3.74500E+00, | 4.44768E+01 |
| −7.35500E−01, | 3.48580E+00, | 4.50691E+01 |
| −2.49800E−01, | 4.40470E+00, | 4.44144E+01 |
| −3.70500E+00, | −1.34000E−02, | 4.48295E+01 |
| −4.40670E+00, | −9.02300E−01, | 4.48814E+01 |
| −3.41000E−01, | 4.36220E+00, | 4.44185E+01 |
| −6.02000E−01, | 3.79570E+00, | 4.50400E+01 |
| −2.54200E−01, | 4.14760E+00, | 4.50034E+01 |
| −4.38620E+00, | −4.19000E−01, | 4.48866E+01 |
| −3.25600E−01, | 4.44070E+00, | 4.49760E+01 |
| −1.88140E+00, | −1.39520E+00, | 4.27838E+01 |
| −1.66920E+00, | −1.00350E+00, | 4.34393E+01 |
| −3.46230E+00, | −1.64260E+00, | 4.34699E+01 |

TABLE I-continued

| X | Y | Z |
|---|---|---|
| −1.04260E+00, | 6.89700E−01, | 4.34324E+01 |
| −3.18380E+00, | −1.77440E+00, | 4.41145E+01 |
| −1.13730E+00, | 2.23400E−01, | 4.27987E+01 |
| −6.84500E−01, | 1.95700E+00, | 4.27584E+01 |
| −9.24100E−01, | 1.12590E+00, | 4.34225E+01 |
| −3.35550E+00, | −1.71200E+00, | 4.41249E+01 |
| −1.96650E+00, | −1.35920E+00, | 4.40706E+01 |
| −1.43360E+00, | −6.22200E−01, | 4.27962E+01 |
| −2.63310E+00, | −1.84250E+00, | 4.27781E+01 |
| −1.07080E+00, | 7.23200E−01, | 4.40474E+01 |
| −2.26070E+00, | −1.67660E+00, | 4.34368E+01 |
| −1.50770E+00, | −5.73300E−01, | 4.40656E+01 |
| −2.73200E+00, | −1.81690E+00, | 4.40925E+01 |
| −1.30990E+00, | −2.74300E−01, | 4.34418E+01 |
| −7.89100E−01, | 1.52140E+00, | 4.27745E+01 |
| −1.20080E+00, | 2.85800E−01, | 4.40566E+01 |
| −3.24420E+00, | −1.73460E+00, | 4.27863E+01 |
| −3.13020E+00, | −1.78580E+00, | 4.34561E+01 |
| −3.40450E+00, | −1.65410E+00, | 4.27905E+01 |
| −9.49300E−01, | 1.16270E+00, | 4.40351E+01 |
| −1.92450E+00, | −1.37630E+00, | 4.34369E+01 |
| −1.70810E+00, | −9.83500E−01, | 4.40676E+01 |
| −8.11700E−01, | 1.56360E+00, | 4.34089E+01 |
| −3.51940E+00, | −1.63120E+00, | 4.41357E+01 |
| −2.21470E+00, | −1.69240E+00, | 4.27781E+01 |
| −8.33600E−01, | 1.60380E+00, | 4.40194E+01 |
| −1.01330E+00, | 6.54100E−01, | 4.27943E+01 |
| −1.16970E+00, | 2.55700E−01, | 4.34390E+01 |
| −3.30010E+00, | −1.72330E+00, | 4.34627E+01 |
| −1.62890E+00, | −1.02560E+00, | 4.27904E+01 |
| −1.47140E+00, | −5.96700E−01, | 4.34416E+01 |
| −8.98100E−01, | 1.08690E+00, | 4.27864E+01 |
| −2.68270E+00, | −1.82960E+00, | 4.34437E+01 |
| −1.27470E+00, | −2.03200E−01, | 4.27992E+01 |
| −1.34370E+00, | −1.47500E−01, | 4.40624E+01 |
| −2.30620E+00, | −1.66180E+00, | 4.40772E+01 |
| −3.07620E+00, | −1.79710E+00, | 4.27828E+01 |
| −2.66640E+00, | 3.64800E−01, | 4.41253E+01 |
| −2.16530E+00, | 7.97000E−01, | 4.40942E+01 |
| −3.76360E+00, | −1.44220E+00, | 4.34860E+01 |
| −5.98800E−01, | 2.44180E+00, | 4.33696E+01 |
| −5.47400E−01, | 2.66180E+00, | 4.33572E+01 |
| −1.72780E+00, | 1.28460E+00, | 4.34335E+01 |
| −2.95710E+00, | 2.04800E−01, | 4.41394E+01 |
| −5.60700E−01, | 2.70980E+00, | 4.39635E+01 |
| −2.40210E+00, | 5.64900E−01, | 4.41097E+01 |
| −1.55510E+00, | 1.56320E+00, | 4.34197E+01 |
| −6.13900E−01, | 2.48830E+00, | 4.39767E+01 |
| −4.10170E+00, | −1.19230E+00, | 4.41819E+01 |
| −1.58440E+00, | 1.60190E+00, | 4.40436E+01 |
| −7.03600E−01, | 2.00250E+00, | 4.33913E+01 |
| −3.82400E+00, | −1.42980E+00, | 4.41588E+01 |
| −3.96300E−01, | 3.32170E+00, | 4.33138E+01 |
| −1.76070E+00, | 1.32150E+00, | 4.40613E+01 |
| −3.61660E+00, | −1.54790E+00, | 4.34778E+01 |
| −1.91630E+00, | 1.01640E+00, | 4.34466E+01 |
| −1.10190E+00, | 2.43490E+00, | 4.33704E+01 |
| −4.46200E−01, | 3.10170E+00, | 4.33293E+01 |
| −3.96590E+00, | −1.31460E+00, | 4.41704E+01 |
| −7.22200E−01, | 2.04580E+00, | 4.40000E+01 |
| −5.08000E−01, | 2.93130E+00, | 4.39493E+01 |
| −4.03900E−01, | 3.37450E+00, | 4.39180E+01 |
| −2.61800E+00, | 3.33300E−01, | 4.34791E+01 |
| −2.12470E+00, | 7.63300E−01, | 4.34582E+01 |
| −1.24440E+00, | 2.14000E+00, | 4.33883E+01 |
| −1.95300E+00, | 1.05160E+00, | 4.40783E+01 |
| −1.42060E+00, | 1.88990E+00, | 4.40252E+01 |
| −1.12120E+00, | 2.48030E+00, | 4.39850E+01 |
| −4.96600E−01, | 2.88170E+00, | 4.33437E+01 |
| −3.90400E+00, | −1.32780E+00, | 4.34944E+01 |
| −4.55800E−01, | 3.15290E+00, | 4.39342E+01 |
| −1.39480E+00, | 1.84900E+00, | 4.34046E+01 |
| −1.26690E+00, | 2.18310E+00, | 4.40057E+01 |
| −2.90510E+00, | 1.74600E−01, | 4.34871E+02 |
| −3.67540E+00, | −1.53610E+00, | 4.41472E+01 |
| −4.03840E+00, | −1.20640E+00, | 4.35026E+01 |
| −2.35750E+00, | 5.32400E−01, | 4.34689E+01 |

TABLE I-continued

| X | Y | Z |
|---|---|---|
| −3.64580E+00, | −3.89000E−02, | 4.41722E+01 |
| −3.04300E−01, | 4.34380E+00, | 4.38337E+01 |
| −2.50300E−01, | 4.34770E+00, | 4.38340E+01 |
| −4.36270E+00, | −5.30300E−01, | 4.42109E+01 |
| −2.08400E−01, | 4.25520E+00, | 4.32360E+01 |
| −3.26630E+00, | 8.36000E−02, | 4.41539E+01 |
| −2.97500E−01, | 3.76190E+00, | 4.32797E+01 |
| −7.70400E−01, | 3.18310E+00, | 4.33204E+01 |
| −4.30580E+00, | −8.49200E−01, | 4.35212E+01 |
| −2.00000E−01, | 4.20200E+00, | 4.32415E+01 |
| −3.51930E+00, | 2.20000E−03, | 4.41658E+01 |
| −7.07300E−01, | 3.33410E+00, | 4.33093E+02 |
| −3.39260E+00, | 4.22000E−02, | 4.41598E+01 |
| −3.26900E−01, | 4.26780E+00, | 4.32322E+01 |
| −4.31480E+00, | −6.23900E−01, | 4.35254E+01 |
| −2.26000E−01, | 4.33490E+00, | 4.38356E+02 |
| −4.31940E+00, | −4.39700E−01, | 4.42091E+01 |
| −4.02900E−01, | 4.15110E+00, | 4.38514E+01 |
| −4.32370E+00, | −7.14800E−01, | 4.35243E+01 |
| −5.83300E−01, | 3.63680E+00, | 4.32859E+01 |
| −3.52500E−01, | 3.59610E+00, | 4.39008E+01 |
| −6.53000E−01, | 3.53920E+00, | 4.39047E+01 |
| −4.26810E+00, | −4.89200E−01, | 4.35253E+01 |
| −9.81700E−01, | 2.78040E+00, | 4.39632E+01 |
| −3.83250E+00, | −1.57300E−01, | 4.35119E+01 |
| −3.01400E−01, | 3.81770E+00, | 4.38826E+01 |
| −4.16750E+00, | −1.07930E+00, | 4.35108E+01 |
| −9.65700E−01, | 2.73270E+00, | 4.33513E+01 |
| −2.50900E−01, | 4.28850E+00, | 4.32318E+01 |
| −5.27000E−01, | 3.84490E+00, | 4.38788E+01 |
| −4.06480E+00, | −2.79800E−01, | 4.35195E+01 |
| −2.78300E−01, | 4.29140E+00, | 4.32309E+01 |
| −4.21440E+00, | −4.06700E−01, | 4.35240E+01 |
| −2.08100E−01, | 4.31410E+00, | 4.38380E+01 |
| −3.58670E+00, | −6.45000E−02, | 4.35043E+01 |
| −3.26500E−01, | 4.32760E+00, | 4.38350E+01 |
| −4.37270E+00, | −5.61300E−01, | 4.42112E+01 |
| −2.48600E−01, | 3.98200E+00, | 4.32611E+01 |
| −4.34060E+00, | −9.17900E−01, | 4.42032E+01 |
| −4.29460E+00, | −5.50100E−01, | 4.35256E+01 |
| −4.61700E−01, | 3.94040E+00, | 4.32609E+01 |
| −4.38990E+00, | −7.42700E−01, | 4.42096E+01 |
| −2.00000E−01, | 4.26090E+00, | 4.38432E+01 |
| −4.38960E+00, | −6.50900E−01, | 4.42110E+01 |
| −4.35010E+00, | −4.98600E−01, | 4.42105E+01 |
| −4.01390E+00, | −1.91300E−01, | 4.41924E+01 |
| −2.50300E−01, | 4.34770E+00, | 4.38340E+01 |
| −4.37270E+00, | −5.61300E−01, | 4.42112E+01 |
| −4.23600E+00, | −3.36500E−01, | 4.42049E+01 |
| −2.77700E−01, | 4.35080E+00, | 4.38333E+01 |
| −1.99200E−01, | 4.22940E+00, | 4.32388E+01 |
| −3.77100E+00, | −8.35000E−02, | 4.41789E+01 |
| −5.89700E−01, | 3.69200E+00, | 4.38919E+01 |
| −4.64800E−01, | 3.99800E+00, | 4.38653E+01 |
| −7.81700E−01, | 3.23460E+00, | 4.39291E+01 |
| −3.41600E−01, | 4.24450E+00, | 4.32341E+01 |
| −4.25200E+00, | −4.60500E−01, | 4.35250E+01 |
| −2.50900E−01, | 4.28850E+00, | 4.32318E+01 |
| −6.45000E−01, | 3.48530E+00, | 4.32978E+01 |
| −3.21100E+00, | 5.53000E−02, | 4.34947E+01 |
| −3.41300E−01, | 4.30450E+00, | 4.38372E+01 |
| −4.30450E+00, | −5.80600E−01, | 4.35256E+01 |
| −8.47300E−01, | 3.08280E+00, | 4.39408E+01 |
| −7.17000E−01, | 3.38670E+00, | 4.39171E+01 |
| −3.04800E−01, | 4.28420E+00, | 4.32310E+01 |
| −4.38300E+00, | −6.04900E−01, | 4.42113E+01 |
| −4.32130E+00, | −6.69300E−01, | 4.35250E+01 |
| −1.99000E−01, | 4.28830E+00, | 4.38406E+01 |
| −3.95090E+00, | −2.14200E−01, | 4.35158E+01 |
| −4.27390E+00, | −9.33900E−01, | 4.35183E+01 |
| −4.16990E+00, | −3.58300E−01, | 4.35228E+01 |
| −4.32180E+00, | −7.60100E−01, | 4.35235E+01 |
| −2.26500E−01, | 4.27580E+00, | 4.32335E+01 |
| −2.50500E−01, | 4.03930E+00, | 4.38635E+01 |
| −3.46150E+00, | −2.43000E−02, | 4.35009E+01 |
| −3.89420E+00, | −1.33600E−01, | 4.41857E+01 |
| −3.71060E+00, | −1.08000E−01, | 4.35081E+01 |

TABLE I-continued

| X | Y | Z |
|---|---|---|
| −3.33600E+00, | 1.48000E−02, | 4.34978E+01 |
| −4.28220E+00, | −5.18800E−01, | 4.35255E+01 |
| −4.37340E+00, | −8.32600E−01, | 4.42069E+01 |
| −4.30450E+00, | −5.80600E−01, | 4.35256E+01 |
| −4.39180E+00, | −6.96900E−01, | 4.42105E+01 |
| −4.33580E+00, | −4.68700E−01, | 4.42099E+01 |
| −5.22300E−01, | 3.78850E+00, | 4.32735E+01 |
| −8.34500E−01, | 3.03250E+00, | 4.33311E+01 |
| −4.01500E−01, | 4.09240E+00, | 4.32477E+01 |
| −4.23210E+00, | −1.06400E+00, | 4.41931E+01 |
| −4.12920E+00, | −2.57600E−01, | 4.41989E+01 |
| −3.46700E−01, | 3.54180E+00, | 4.32973E+01 |
| −4.28110E+00, | −3.85300E−01, | 4.42072E+01 |
| −2.56980E+00, | 3.01400E−01, | 4.28158E+01 |
| −3.88400E−01, | 3.26670E+00, | 4.26852E+01 |
| −5.83500E−01, | 2.39320E+00, | 4.27382E+01 |
| −2.08420E+00, | 7.28800E−01, | 4.28034E+01 |
| −1.08250E+00, | 2.38770E+00, | 4.27326E+01 |
| −1.69490E+00, | 1.24660E+00, | 4.27854E+01 |
| −1.87970E+00, | 9.80300E−01, | 4.27952E+01 |
| −5.33900E−01, | 2.61150E+00, | 4.27265E+01 |
| −4.36500E−01, | 3.04830E+00, | 4.27000E+01 |
| −9.49400E−01, | 2.68290E+00, | 4.27155E+01 |
| −2.85320E+00, | 1.44200E−01, | 4.28189E+01 |
| −2.31310E+00, | 4.99300E−01, | 4.28102E+01 |
| −1.52570E+00, | 1.52300E+00, | 4.27745E+01 |
| −1.22180E+00, | 2.09520E+00, | 4.27482E+01 |
| −3.84140E+00, | −1.34140E+00, | 4.28068E+01 |
| −4.84900E−01, | 2.82990E+00, | 4.27139E+01 |
| −1.36890E+00, | 1.80660E+00, | 4.27621E+01 |
| −3.97430E+00, | −1.22090E+00, | 4.28126E+01 |
| −3.70250E+00, | −1.45490E+00, | 4.28011E+01 |
| −3.55710E+00, | −1.55990E+00, | 4.27955E+01 |
| −3.40800E−01, | 3.48530E+00, | 4.26693E+01 |
| −3.88730E+00, | −2.37300E−01, | 4.28279E+01 |
| −2.78900E−01, | 4.22950E+00, | 4.26039E+01 |
| −4.25290E+00, | −7.77900E−01, | 4.28280E+01 |
| −4.18370E+00, | −4.81600E−01, | 4.28310E+01 |
| −4.25210E+00, | −6.88000E−01, | 4.28295E+01 |
| −8.21500E−01, | 2.98020E+00, | 4.26972E+01 |
| −2.51500E−01, | 4.22690E+00, | 4.26051E+01 |
| −4.20630E+00, | −9.50100E−01, | 4.28237E+01 |
| −4.10310E+00, | −3.80300E−01, | 4.28305E+01 |
| −3.40340E+00, | −5.09000E−02, | 4.28225E+01 |
| −6.36900E−01, | 3.42920E+00, | 4.26665E+01 |
| −3.64980E+00, | −1.32700E−01, | 4.28249E+01 |
| −2.46600E−01, | 3.92230E+00, | 4.26344E+01 |
| −4.21340E+00, | −5.39200E−01, | 4.28309E+01 |
| −4.58500E−01, | 3.88050E+00, | 4.26319E+01 |
| −4.23540E+00, | −6.00300E−01, | 4.28305E+01 |
| −3.41800E−01, | 4.18210E+00, | 4.26066E+01 |
| −3.05400E−01, | 4.22210E+00, | 4.26038E+01 |
| −7.59100E−01, | 3.12960E+00, | 4.26874E+01 |
| −2.51500E−01, | 4.22690E+00, | 4.26051E+01 |
| −1.99300E−01, | 4.16820E+00, | 4.26126E+01 |
| −3.27930E+00, | −1.27000E−02, | 4.28217E+01 |
| −3.15560E+00, | 2.68000E−02, | 4.28210E+01 |
| −5.76800E−01, | 3.57950E+00, | 4.26555E+01 |
| −2.27000E−01, | 4.21440E+00, | 4.26071E+01 |
| −4.23740E+00, | −8.66100E−01, | 4.28260E+01 |
| −4.00000E−01, | 4.03130E+00, | 4.26194E+01 |
| −4.19950E+00, | −5.09900E−01, | 4.28310E+01 |
| −4.24560E+00, | −6.43100E−01, | 4.28301E+01 |
| −4.10190E+00, | −1.09490E+00, | 4.28182E+01 |
| −5.17400E−01, | 3.72990E+00, | 4.26439E+01 |
| −6.97500E−01, | 3.27930E+00, | 4.26771E+01 |
| −4.14670E+00, | −4.28300E−01, | 4.28309E+01 |
| −4.25460E+00, | −7.33000E−01, | 4.28288E+01 |
| −3.77020E+00, | −1.81200E−01, | 4.28264E+01 |
| −4.22570E+00, | −5.70100E−01, | 4.28308E+01 |
| −2.93500E−01, | 3.70380E+00, | 4.26524E+01 |
| −3.99970E+00, | −3.02200E−01, | 4.28293E+01 |
| −3.52710E+00, | −9.00000E−02, | 4.28236E+01 |
| −1.99900E−01, | 4.14080E+00, | 4.26153E+01 |
| −3.27400E−01, | 4.20560E+00, | 4.26048E+01 |
| −4.23540E+00, | −6.00300E−01, | 4.28305E+01 |
| −2.08800E−01, | 4.19390E+00, | 4.26097E+01 |

TABLE I-continued

| X | Y | Z |
|---|---|---|
| −7.43000E−01, | 1.43040E+00, | 4.14124E+01 |
| −2.96460E+00, | −1.81920E+00, | 4.13822E+01 |
| −9.52700E−01, | 5.76800E−01, | 4.14297E+01 |
| −1.49440E+00, | −1.10510E+00, | 4.06857E+01 |
| −1.35260E+00, | −6.79200E−01, | 4.14239E+01 |
| −3.37300E+00, | −1.59670E+00, | 4.06694E+01 |
| −1.23840E+00, | −2.33900E−01, | 4.21292E+01 |
| −3.34560E+00, | −1.66570E+00, | 4.20955E+01 |
| −1.78970E+00, | −1.43810E+00, | 4.14024E+01 |
| −1.58650E+00, | −1.04950E+00, | 4.21160E+01 |
| −8.44700E−01, | 1.00280E+00, | 4.14232E+01 |
| −7.66300E−01, | 1.47710E+00, | 4.21099E+01 |
| −3.12890E+00, | −1.75680E+00, | 4.13830E+01 |
| −1.03220E+00, | 1.13400E−01, | 4.07005E+01 |
| −3.22540E+00, | −1.68880E+00, | 4.06657E+01 |
| −2.11860E+00, | −1.72700E+00, | 4.13911E+01 |
| −8.71700E−01, | 1.04610E+00, | 4.21208E+01 |
| −9.83500E−01, | 6.16600E−01, | 4.21276E+01 |
| −3.49660E+00, | −1.57200E+00, | 4.20987E+01 |
| −2.47840E+00, | −1.88180E+00, | 4.06571E+01 |
| −1.10420E+00, | 1.89300E−01, | 4.21304E+01 |
| −3.02090E+00, | −1.80830E+00, | 4.20916E+01 |
| −1.83650E+00, | −1.41560E+00, | 4.21061E+01 |
| −3.43500E+00, | −1.58430E+00, | 4.13869E+01 |
| −1.20030E+00, | −2.66900E−01, | 4.14300E+01 |
| −3.28570E+00, | −1.67720E+00, | 4.13845E+01 |
| −2.90780E+00, | −1.83010E+00, | 4.06595E+01 |
| −1.30750E+00, | −7.12200E−01, | 4.06945E+01 |
| −1.74070E+00, | −1.46300E+00, | 4.06744E+01 |
| −1.54210E+00, | −1.07570E+00, | 4.14143E+01 |
| −9.19300E−01, | 5.33800E−01, | 4.06972E+01 |
| −1.39410E+00, | −6.49600E−01, | 4.21243E+01 |
| −2.58240E+00, | −1.85550E+00, | 4.20921E+01 |
| −6.25200E−01, | 1.80560E+00, | 4.06606E+01 |
| −1.15880E+00, | −3.03100E−01, | 4.06996E+01 |
| −3.07030E+00, | −1.76780E+00, | 4.06623E+01 |
| −2.06860E+00, | −1.74640E+00, | 4.06632E+01 |
| −7.18100E−01, | 1.38060E+00, | 4.06772E+01 |
| −3.18710E+00, | −1.74570E+00, | 4.20933E+01 |
| −2.16720E+00, | −1.70910E+00, | 4.20967E+01 |
| −1.06980E+00, | 1.53000E−01, | 4.14320E+01 |
| −6.65400E−01, | 1.90940E+00, | 4.20948E+01 |
| −6.45900E−01, | 1.85910E+00, | 4.13972E+01 |
| −8.15600E−01, | 9.56500E−01, | 4.06894E+01 |
| −2.53070E+00, | −1.86850E+00, | 4.13843E+01 |
| −1.62790E+00, | 1.16680E+00, | 4.14114E+01 |
| −1.06300E+00, | 2.33860E+00, | 4.20663E+01 |
| −4.26800E−01, | 2.99220E+00, | 4.20382E+01 |
| −4.61500E−01, | 2.71810E+00, | 4.13535E+01 |
| −5.20400E−01, | 2.55880E+00, | 4.20640E+01 |
| −1.19890E+00, | 2.04880E+00, | 4.20803E+01 |
| −3.77770E+00, | −1.35520E+00, | 4.21063E+01 |
| −4.73300E−01, | 2.77550E+00, | 4.20516E+01 |
| −1.49600E+00, | 1.48150E+00, | 4.21030E+01 |
| −5.06600E−01, | 2.50310E+00, | 4.13661E+01 |
| −1.31610E+00, | 1.71700E+00, | 4.13942E+01 |
| −3.64040E+00, | −1.46780E+00, | 4.21023E+01 |
| −1.34260E+00, | 1.76260E+00, | 4.20925E+01 |
| −2.22270E+00, | 4.31000E−01, | 4.14247E+01 |
| −2.00180E+00, | 6.57200E−01, | 4.14221E+01 |
| −2.74760E+00, | 8.22000E−02, | 4.14243E+01 |
| −2.47150E+00, | 2.36000E−01, | 4.14259E+01 |
| −9.16800E−01, | 2.57690E+00, | 4.13540E+01 |
| −1.46600E+00, | 1.43850E+00, | 4.14037E+01 |
| −1.04330E+00, | 2.28730E+00, | 4.13694E+01 |
| −3.90920E+00, | −1.23580E+00, | 4.21102E+01 |
| −2.04320E+00, | 6.93500E−01, | 4.21251E+01 |
| −2.52090E+00, | 2.69000E−01, | 4.21319E+01 |
| −2.26810E+00, | 4.65500E−01, | 4.21292E+01 |
| −5.68100E−01, | 2.34210E+00, | 4.20754E+01 |
| −3.72700E−01, | 3.14790E+00, | 4.13251E+01 |
| −1.66160E+00, | 1.20740E+00, | 4.21119E+01 |
| −2.80060E+00, | 1.13400E−01, | 4.21316E+02 |
| −5.52400E−01, | 2.28830E+00, | 4.13776E+01 |
| −4.16900E−01, | 2.93290E+00, | 4.13399E+01 |
| −1.84260E+00, | 9.43100E−01, | 4.21193E+01 |
| −1.17590E+00, | 2.00030E+00, | 4.13828E+01 |

TABLE I-continued

| X | Y | Z |
|---|---|---|
| −3.80600E−01, | 3.20890E+00, | 4.20236E+01 |
| −1.80510E+00, | 9.04800E−01, | 4.14175E+01 |
| −2.44600E−01, | 3.85940E+00, | 4.19734E+01 |
| −3.70710E+00, | −2.05300E−01, | 4.21275E+01 |
| −1.99500E−01, | 4.10350E+00, | 4.19519E+01 |
| −4.15560E+00, | −5.90500E−01, | 4.21253E+01 |
| −3.05900E−01, | 4.15670E+00, | 4.19429E+01 |
| −3.09950E+00, | −1.90000E−03, | 4.21300E+01 |
| −3.46680E+00, | −1.15900E−01, | 4.21279E+01 |
| −5.07700E−01, | 3.60370E+00, | 4.12848E+01 |
| −6.87800E−01, | 3.22190E+00, | 4.20142E+01 |
| −2.27500E−01, | 4.14960E+00, | 4.19464E+01 |
| −1.99900E−01, | 4.00770E+00, | 4.12550E+01 |
| −6.20500E−01, | 3.30880E+00, | 4.13071E+01 |
| −3.97100E−01, | 3.89920E+00, | 4.12605E+01 |
| −3.98600E−01, | 3.96700E+00, | 4.19583E+01 |
| −4.18280E+00, | −7.96000E−01, | 4.21220E+01 |
| −2.52100E−01, | 4.16190E+00, | 4.19443E+01 |
| −3.34900E−01, | 3.42580E+00, | 4.20080E+01 |
| −3.22170E+00, | −4.05000E−02, | 4.21292E+01 |
| −3.28300E−01, | 4.07070E+00, | 4.12455E+01 |
| −4.16520E+00, | −6.20200E−01, | 4.21249E+01 |
| −4.13760E+00, | −9.66700E−01, | 4.21182E+01 |
| −2.80100E−01, | 4.09540E+00, | 4.12443E+01 |
| −3.29000E−01, | 3.36290E+00, | 4.13093E+01 |
| −3.34450E+00, | −7.77000E−02, | 4.21284E+01 |
| −8.08400E−01, | 2.92570E+00, | 4.20333E+01 |
| −4.11440E+00, | −5.03000E−01, | 4.21262E+01 |
| −9.33200E−01, | 2.63110E+00, | 4.20505E+01 |
| −4.18190E+00, | −7.07000E−01, | 4.21236E+01 |
| −2.09500E−01, | 4.06070E+00, | 4.12496E+01 |
| −2.89600E−01, | 3.64250E+00, | 4.19912E+01 |
| −3.82260E+00, | −2.60700E−01, | 4.21274E+01 |
| −2.52700E−01, | 4.09310E+00, | 4.12453E+01 |
| −4.16520E+00, | −6.20200E−01, | 4.21249E+01 |
| −4.03520E+00, | −4.02600E−01, | 4.21269E+01 |
| −1.99900E−01, | 4.07610E+00, | 4.19546E+01 |
| −3.58800E+00, | −1.57700E−01, | 4.21276E+01 |
| −7.47700E−01, | 3.07360E+00, | 4.20240E+01 |
| −4.14360E+00, | −5.60000E−01, | 4.21256E+01 |
| −6.77900E−01, | 3.16180E+00, | 4.13175E+01 |
| −5.70300E−01, | 3.51930E+00, | 4.19932E+01 |
| −2.85700E−01, | 3.57780E+00, | 4.12924E+01 |
| −3.27800E−01, | 4.14000E+00, | 4.19438E+01 |
| −4.52200E−01, | 3.75140E+00, | 4.12729E+01 |
| −6.28700E−01, | 3.37050E+00, | 4.20039E+01 |
| −2.09100E−01, | 4.12920E+00, | 4.19491E+02 |
| −2.42600E−01, | 3.79280E+00, | 4.12742E+01 |
| −2.79500E−01, | 4.16440E+00, | 4.19430E+01 |
| −7.95300E−01, | 2.86860E+00, | 4.13367E+01 |
| −4.12990E+00, | −5.31000E−01, | 4.21259E+01 |
| −2.52100E−01, | 4.16190E+00, | 4.19443E+01 |
| −1.99700E−01, | 4.03510E+00, | 4.12525E+01 |
| −3.93360E+00, | −3.24900E−01, | 4.21272E+01 |
| −3.42400E−01, | 4.04720E+00, | 4.12475E+01 |
| −4.07810E+00, | −4.50200E−01, | 4.21266E+01 |
| −2.28000E−01, | 4.08100E+00, | 4.12471E+01 |
| −5.63800E−01, | 3.45620E+00, | 4.12962E+01 |
| −3.06600E−01, | 4.08760E+00, | 4.12444E+01 |
| −5.12600E−01, | 3.66840E+00, | 4.19820E+01 |
| −4.55300E−01, | 3.81760E+00, | 4.19703E+01 |
| −4.17540E+00, | −6.62700E−01, | 4.21243E+01 |
| −2.52700E−01, | 4.09310E+00, | 4.12453E+01 |
| −4.03540E+00, | −1.11090E+00, | 4.21142E+01 |
| −7.36200E−01, | 3.01500E+00, | 4.13274E+01 |
| −3.42100E−01, | 4.11650E+00, | 4.19457E+01 |
| −4.16790E+00, | −8.83400E−01, | 4.21201E+01 |
| −4.18440E+00, | −7.51500E−01, | 4.21228E+01 |
| −1.02280E+00, | 2.23370E+00, | 4.06393E+01 |
| −3.57720E+00, | −1.48090E+00, | 4.13898E+01 |
| −2.42210E+00, | 2.03100E−01, | 4.07002E+01 |
| −5.35900E−01, | 2.23120E+00, | 4.06395E+01 |
| −4.92200E−01, | 2.44410E+00, | 4.06272E+01 |
| −2.98630E+00, | −5.93000E−02, | 4.07007E+01 |
| −1.59360E+00, | 1.12500E+00, | 4.06852E+01 |
| −1.15200E+00, | 1.94980E+00, | 4.06540E+01 |
| −3.90040E+00, | −1.14370E+00, | 4.06847E+01 |

TABLE I-continued

| X | Y | Z |
|---|---|---|
| −1.43520E+00, | 1.39390E+00, | 4.06768E+01 |
| −3.84310E+00, | −1.25100E+00, | 4.13961E+01 |
| −3.64820E+00, | −1.38360E+00, | 4.06771E+01 |
| −4.06600E−01, | 2.87000E+00, | 4.05994E+01 |
| −3.22800E−01, | 3.29600E+00, | 4.05671E+01 |
| −3.04280E+00, | −3.09000E−02, | 4.14213E+01 |
| −1.76710E+00, | 8.65600E−01, | 4.06915E+01 |
| −1.28890E+00, | 1.66950E+00, | 4.06665E+01 |
| −8.99800E−01, | 2.52010E+00, | 4.06226E+01 |
| −3.77690E+00, | −1.26640E+00, | 4.06810E+01 |
| −3.51380E+00, | −1.49420E+00, | 4.06733E+01 |
| −2.17700E+00, | 3.96100E−01, | 4.06988E+01 |
| −1.96000E+00, | 6.20300E−01, | 4.06960E+01 |
| −3.64500E−01, | 3.08300E+00, | 4.05838E+01 |
| −2.69460E+00, | 5.14000E−02, | 4.07007E+01 |
| −3.71300E+00, | −1.36930E+00, | 4.13928E+01 |
| −4.49100E−01, | 2.65710E+00, | 4.06139E+01 |
| −4.00210E+00, | −6.01900E−01, | 4.06963E+01 |
| −3.69190E+00, | −3.07600E−01, | 4.06995E+01 |
| −4.02300E+00, | −6.60500E−01, | 4.06954E+01 |
| −7.81800E−01, | 2.80850E+00, | 4.06037E+01 |
| −3.89770E+00, | −4.47500E−01, | 4.06982E+01 |
| −2.10000E−01, | 3.98780E+00, | 4.05049E+01 |
| −3.22550E+00, | −1.31100E−01, | 4.07005E+01 |
| −4.10410E+00, | −6.82500E−01, | 4.14086E+01 |
| −2.80900E−01, | 4.02210E+00, | 4.05015E+01 |
| −3.96790E+00, | −1.12720E+00, | 4.13992E+01 |
| −2.53500E−01, | 4.01990E+00, | 4.05017E+01 |
| −3.86660E+00, | −3.47900E−01, | 4.14134E+01 |
| −5.57100E−01, | 3.38940E+00, | 4.05593E+01 |
| −4.09740E+00, | −9.01000E−01, | 4.14044E+01 |
| −6.12100E−01, | 3.24380E+00, | 4.05712E+01 |
| −5.02800E−01, | 3.53520E+00, | 4.05469E+01 |
| −4.11320E+00, | −7.70400E−01, | 4.14070E+01 |
| −4.05930E+00, | −5.52300E−01, | 4.14107E+01 |
| −2.40600E−01, | 3.72200E+00, | 4.05301E+01 |
| −3.64310E+00, | −2.29600E−01, | 4.14152E+01 |
| −3.16360E+00, | −6.85000E−02, | 4.14199E+01 |
| −4.00840E+00, | −4.72400E−01, | 4.14118E+01 |
| −3.79970E+00, | −3.70600E−01, | 4.06990E+01 |
| −4.08460E+00, | −6.11000E−01, | 4.14098E+01 |
| −4.03300E+00, | −7.02300E−01, | 4.06947E+01 |
| −3.42900E−01, | 3.97350E+00, | 4.05063E+01 |
| −3.40580E+00, | −1.42000E−01, | 4.14172E+01 |
| −4.02690E+00, | −9.18700E−01, | 4.06903E+01 |
| −7.24400E−01, | 2.95330E+00, | 4.05934E+01 |
| −4.04210E+00, | −7.89200E−01, | 4.06931E+01 |
| −3.57930E+00, | −2.53600E−01, | 4.06999E+01 |
| −4.11180E+00, | −8.14400E−01, | 4.14062E+01 |
| −3.07300E−01, | 4.01410E+00, | 4.05023E+01 |
| −3.10570E+00, | −9.59000E−02, | 4.07006E+01 |
| −3.93890E+00, | −4.94400E−01, | 4.06977E+01 |
| −3.34500E+00, | −1.67500E−01, | 4.07004E+01 |
| −3.98880E+00, | −5.73500E−01, | 4.06966E+01 |
| −4.01370E+00, | −6.31500E−01, | 4.06958E+01 |
| −4.11060E+00, | −7.26300E−01, | 4.14078E+01 |
| −2.53500E−01, | 4.01990E+00, | 4.05017E+01 |
| −2.00000E−01, | 3.96230E+00, | 4.05074E+01 |
| −4.09400E+00, | −6.40400E−01, | 4.14093E+01 |
| −4.06790E+00, | −9.83700E−01, | 4.14027E+01 |
| −3.28490E+00, | −1.04700E−01, | 4.14184E+01 |
| −3.95700E−01, | 3.82730E+00, | 4.05203E+01 |
| −4.49000E−01, | 3.68120E+00, | 4.05339E+01 |
| −4.07280E+00, | −5.81000E−01, | 4.14102E+01 |
| −4.09400E+00, | −6.40400E−01, | 4.14093E+01 |
| −2.28700E−01, | 4.00790E+00, | 4.05029E+01 |
| −3.99820E+00, | −1.00070E+00, | 4.06884E+01 |
| −2.81500E−01, | 3.50900E+00, | 4.05491E+01 |
| −4.04410E+00, | −5.24600E−01, | 4.14110E+01 |
| −3.52560E+00, | −1.82800E−01, | 4.14162E+01 |
| −3.75720E+00, | −2.84300E−01, | 4.14143E+01 |
| −4.03950E+00, | −7.45600E−01, | 4.06939E+01 |
| −3.96640E+00, | −4.25100E−01, | 4.14124E+01 |
| −4.02300E+00, | −6.60500E−01, | 4.06954E+01 |
| −2.00000E−01, | 3.93490E+00, | 4.05100E+01 |
| −4.04080E+00, | −8.32800E−01, | 4.06922E+01 |
| −3.97380E+00, | −5.46100E−01, | 4.06970E+01 |

TABLE I-continued

| X | Y | Z |
|---|---|---|
| −3.28900E−01, | 3.99720E+00, | 4.05040E+01 |
| −3.46330E+00, | −2.07500E−01, | 4.07002E+01 |
| −6.67800E−01, | 3.09850E+00, | 4.05826E+01 |

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A nozzle blade for a turbine having an airfoil, the airfoil having an uncoated nominal profile substantially in accordance with Cartesian coordinate values of X, Y and Z set forth in inches in Table I which define a plurality of radially spaced profile sections forming said nominal profile, the Z coordinate values for each profile section being radial distances from the turbine axis to a portion of a surface of revolution about said turbine axis containing the profile section, and the X and Y values for each profile section being coordinate values which, when connected by smooth continuing arcs define the airfoil profile section along said surface of revolution portion, the radially spaced profile sections being joined smoothly with one another to form the nominal airfoil profile.

2. A nozzle blade according to claim 1 forming part of a first stage of a turbine.

3. A nozzle blade for a turbine having an airfoil, the airfoil having a shape in an envelope within ±0.160 inches in a direction normal to any airfoil surface location, the airfoil having an uncoated nominal profile substantially in accordance with Cartesian coordinate values of X, Y and Z set forth in inches in Table I which define a plurality of radially spaced profile sections forming said nominal profile, the Z coordinate values for each profile section being radial distances from the turbine axis to a portion of a surface of revolution about said turbine axis containing the profile section, and the X and Y values for each profile section being coordinate values which, when connected by smooth continuing arcs define the airfoil profile section along said surface of revolution portion, the radially spaced profile sections being joined smoothly with one another to form the nominal airfoil profile.

4. A nozzle blade according to claim 3 forming part of a first stage of a turbine.

5. A turbine having a plurality of nozzle blades forming a portion of a turbine stage, each said nozzle blade being in the shape of an airfoil, each airfoil having an uncoated nominal profile substantially in accordance with Cartesian coordinate values of X, Y and Z set forth in inches in Table I which define a plurality of radially spaced profile sections forming said nominal profile, the Z coordinate values for each profile section being radial distances from the turbine axis to a portion of a surface of revolution about said turbine axis containing the profile section, and the X and Y values for each profile section being coordinate values which, when connected by smooth continuing arcs define the airfoil profile section along said surface of revolution portion, the radially spaced profile sections being joined smoothly with one another to form the nominal airfoil profile.

6. A turbine according to claim 5 wherein said nozzle blades form part of a first stage of the turbine.

7. A turbine having a plurality of nozzle blades forming a portion of a turbine stage, each said nozzle blade being in the shape of an airfoil, each said airfoil having an uncoated nominal profile substantially in accordance with Cartesian coordinate values of X, Y and Z set forth in inches in Table I which define a plurality of radially spaced profile sections forming said nominal profile, the Z coordinate values for each profile section being radial distances from the turbine axis to a portion of a surface of revolution about said turbine axis containing the profile section, and the X and Y values for each profile section being coordinate values which, when connected by smooth continuing arcs define the airfoil profile section along said surface of revolution portion, the radially spaced profile sections being joined smoothly with one another to form the nominal airfoil profile, each said airfoil having a shape within ±0.0160 inches in a direction normal to any airfoil surface location.

8. A turbine according to claim 7 wherein said nozzle blades form part of a first stage of a turbine.

9. A turbine according to claim 7 wherein each said airfoil forms part of a nozzle segment containing said airfoil and inner and outer sidewalls.

* * * * *